US006389699B1

(12) United States Patent
Ecer

(10) Patent No.: US 6,389,699 B1
(45) Date of Patent: May 21, 2002

(54) SELF SHARPENING BLADES AND METHOD FOR MAKING SAME

(75) Inventor: Gunes M. Ecer, Thousand Oaks, CA (US)

(73) Assignee: Globix Technologies, Inc., Thousand Oaks, CA (US)

( * ) Notice: Subject to any disclaimer, the term of this patent is extended or adjusted under 35 U.S.C. 154(b) by 48 days.

(21) Appl. No.: 09/596,179

(22) Filed: Jun. 16, 2000

Related U.S. Application Data

(62) Division of application No. 09/084,431, filed on May 26, 1998, now Pat. No. 6,105,261.

(51) Int. Cl.[7] ..... B26B 21/54; B21K 11/00

(52) U.S. Cl. ..... 30/346.54; 30/350; 76/104.1; 76/DIG. 6; 76/DIG. 8

(58) Field of Search ..... 30/346.54, 350; 76/104.1, DIG. 8, DIG. 6; 75/245, 226; 419/6; 428/565, 547; 204/192; 228/173

(56) References Cited

U.S. PATENT DOCUMENTS 1,057,423 A * 4/1913 Haynes ..... 30/350
1,274,250 A * 7/1918 Driver ..... 30/350
1,277,431 A * 9/1918 Kuehnrich ..... 30/350
1,299,404 A * 4/1919 Haynes ..... 30/350
2,251,410 A * 8/1941 Koehring et al. ..... 428/547
3,387,368 A * 6/1968 Scheck ..... 30/350
3,635,811 A * 1/1972 Lane ..... 204/192
3,744,993 A * 7/1973 Matt et al. ..... 30/350
3,802,078 A * 4/1974 Denes ..... 30/350
3,805,387 A 4/1974 Siegmund et al.
3,810,757 A * 5/1974 Andrews et al. ..... 419/6
3,829,969 A * 8/1974 Fischbein et al. ..... 30/346.54
3,836,392 A * 9/1974 Lux et al. ..... 30/350
3,837,896 A * 9/1974 Lindstrom et al. ..... 30/346.54
3,874,900 A * 4/1975 Post et al. ..... 30/350
3,889,349 A * 6/1975 Kaufman ..... 228/173
3,911,579 A * 10/1975 Lane et al. ..... 30/346.54
3,975,891 A * 8/1976 Gunther ..... 30/350
4,212,669 A * 7/1980 Veeck et al. ..... 75/226
4,330,576 A 5/1982 Dodd
4,403,015 A * 9/1983 Nakai et al. ..... 428/565
4,470,953 A * 9/1984 Bruce ..... 419/6
4,702,004 A 10/1987 Haythornthwaite
4,945,640 A * 8/1990 Garg et al. ..... 76/104.1
5,048,191 A 9/1991 Hahn
5,056,227 A 10/1991 Kramer
5,088,202 A 2/1992 Boland et al.
5,121,660 A 6/1992 Kramer
5,129,289 A 7/1992 Boland et al.
5,142,785 A 9/1992 Grewal et al.
5,256,496 A * 10/1993 Kluczynski ..... 30/350

OTHER PUBLICATIONS

"Welding Processes For Plastics", Advanced Materials & Processes, Mar., 1995, Robert A. Grimm, pp. 27–30.

* cited by examiner

*Primary Examiner*—M. Rachuba
(74) *Attorney, Agent, or Firm*—William W. Haefliger

(57) ABSTRACT

In a self-sharpening blade having a cutting edge, the combination comprising a layered structure, the structure including a relatively harder first layer with relatively higher wear resistance extending to the blade cutting edge, and the structure also including a second layer characterized by relatively lesser hardness and lesser wear resistance and located at one side of the first layer.

34 Claims, 8 Drawing Sheets

SELF SHARPENING BLADES AND METHOD FOR MAKING SAME

This application is a division of Ser. No. 09/084,431, filed Nov. 26, 1998, now U.S. Pat. No. 6,105,261.

BACKGROUND OF THE INVENTION

The present invention relates to cutting blades, such as saw blades, and processes of producing such blades, and is more particularly directed to improvements in blades with self-sharpening cutting edges.

Cutting and saw blades are used in a variety of household and industrial applications, including razors, knives, shears, agricultural implements, rotary cutters and slicers, chisels, power saws, band saws, and hand held hack saws.

Users desire cutting blades with sharp edges possessing long life and corrosion resistance. Typically, blades are initially sharpened to form a wedge shaped cutting edge and re-sharpened as needed, except in the case of razor blades which cannot be re-sharpened.

Sharpness of a cutting blade is measured in terms of "ultimate tip radius", which is different depending on the application. For kitchen knives, rotary cutters, and similar cutting instruments, ultimate tip radius may be several thousand Angstroms. In agricultural implements incorporating rotary blades that cut through the soil, axes, and in chisels, the cutting edge radius may be expressed in microns or even in millimeters rather than Angstroms. Shaving razor blades ordinarily have ultimate tip radii of about 1,500 Angstroms or less. This radius usually includes a layer of hard material coating applied to the wedge shaped base material of the razor blade.

Among cutting blades, razor blades incorporate the most stringent technological requirements. Typically, a base material (usually a martensitic stainless steel strip) is ground and honed on one edge to a wedge shape with an included angle of 30 degrees or less, coated with a 200–900 Angstrom thick layer of hard material for improved life, and coated with up to 10 $\mu$m thick layer of low friction coefficient organosiloxane gel, or a fluorocarbon polymer.

Many variations of the contemporary razor blade technology have been proposed. Polycrystalline ceramics were proposed as the base material by Kramer (U.S. Pat. Nos. 5,056,227 and 5,142,785) and by Hahn (U.S. Pat. No. 5,048,191). A totally glass razor was the subject of U.S. Pat. No. 4,702,004 to Haythornthwaite, and a compaction of hollow fibers was offered by Siegmund and Strack in their U.S. Pat. No. 3,805,387. As hard coatings, boron carbide (U.S. Pat. No. 5,129,289 by Boland et al.), diamond, and diamond-like carbon (DLC) coatings were offered in U.S. Pat. No. 5,142,785 by Kramer. Methods of application of fluorinated polymer films can be found in U.S. Pat. No. 5,088,202 to Boland et al., and in U.S. Pat. No. 4,330,576 to Dodd.

Like blades for knives and rotary cutters, razor blades are sharpened to ideal wedge angles and cutting tip radii in order to perform satisfactorily. Unfortunately, as soon as these blades are subjected to wear conditions in service, they begin to loose their sharpness. In other words, their ultimate performance can only occur at the beginning of their service life and their performance will continually diminish with time. This happens by loss of material from the blade tip which leads to increase of tip radius.

In most cases, cutting blades become dull by gradual loss of material due to wear of cutting edges. Wear mechanisms may include general and grain boundary corrosion, as well as chipping and loss of grains due to weak grain boundaries. In general, the harder the material, the more resistant it is to wear. However, if grain boundary weakness and loss of grains are part of the wear mechanism, hardness alone may not be the most important factor determining wear resistance.

Saw blades may be made of a single metallic material, or may have teeth with welded or bonded carbide tips. Initial sharpness of saw blades diminish with time and the blades must either be thrown away or re-sharpened. When a carbide tip wears, it must be reapplied, which consumes valuable time.

This invention provides a solution to the problem of blade edge dulling by providing self-sharpening blades with layered structures where the thickness of the most wear resistant layer determines the sharpness of the blade, and as the blade wears in service, cutting tip diameter, and therefore the blade sharpness, remains unchanged. Saw blades provided by this invention are similarly self-sharpening type blades.

SUMMARY OF THE INVENTION

It is an object of this invention to provide self-sharpening cutting blades of the types used in shaving razors, kitchen knives, industrial knives, shears, agricultural implements, earth and rock cutting tools, rotary cutters, rotary slicers, chisels, axes, and other similar cutting instruments.

It is another object of this invention to provide self-sharpening saw blades of the types used in power saws, hand-held hack saws, and other similar sawing instruments.

Another object is to provide a layered composite or laminate which comprises a) a layered structure, b) that structure including a relatively harder first layer with relatively higher wear resistance extending to a blade cutting edge, c) the structure also including a second layer characterized by relatively lesser hardness and lesser wear resistance and located at one side of the first layer.

A further object is to provide a third layer also characterized by relatively lesser hardness and wear resistance than that of the first layer, the second and third layers located at opposite sides of the first layer.

The foregoing and other objects and advantages are in part attained by selection of various materials that make-up self-sharpening cutting blades and saw blades on the basis of their wear resistance. This invention provides a solution to the problem of blade edge dulling experienced in conventional cutting blades and saw blades by providing self-sharpening blades with layered structures where in the most wear resistant layer thickness determines the sharpness of the blades, and as the blade wears in service, cutting tip diameter, and therefore the blade sharpness, remains unchanged. Saw blades provided by this invention are similarly self-sharpening type blades.

In its simplest form, a self-sharpening cutting blade is created by placing a hard material layer of pre-selected thickness and high wear resistance at the center of the blade body and extending to the cutting edge, and within a matrix body material possessing lesser wear resistance. Relative difference in wear resistance of the higher wear resistant material at the central cutting tip of the blade, versus the relatively lower wear resistance of the rest of the blade, creates a self-sharpening effect in service. Because the softer, less wear resistant matrix material wears faster than the more wear resistant hard material layer located in the center of the blade's cross-section, the hard material layer is always exposed at the very tip of the blade. Additionally, the hard material layer thickness is selected to be approximately equal to the "ultimate tip diameter", and is substantially the same everywhere within the hard layer. Thus, as the cutting edge of the blade wears in service, exposed hard material layer at the very tip of the cutting edge will always have the ideal "ultimate tip diameter", and provide the best performance in service.

Similar to cutting blades, in self-sharpening saw blades of this invention a hard material layer selected for its high wear resistance wears less than the matrix material when subjected to wear conditions in service. Because the hard material layer has a constant or uniform thickness optimally selected for a given application, its sharpness, and therefore the performance of the saw, is maintained throughout usage of the saw. Thus, the self-sharpening saws of this invention perform at their best and last considerably longer than conventional saw blades, which begin to dull immediately after first usage.

These and other objects and advantages of the invention, as well as the details of an illustrative embodiment, will be more fully understood from the following specification and drawings, in which:

DRAWING DESCRIPTION

The following specification, taken in conjunction with the drawings, sets forth the preferred embodiments of the present invention. The embodiments of the invention disclosed herein are the best modes contemplated by the inventor for carrying out his invention in a commercial environment, although it is understood that several modifications can be accomplished within the scope of the invention.

DESCRIPTION OF THE PREFERRED EMBODIMENT

Figure 1:
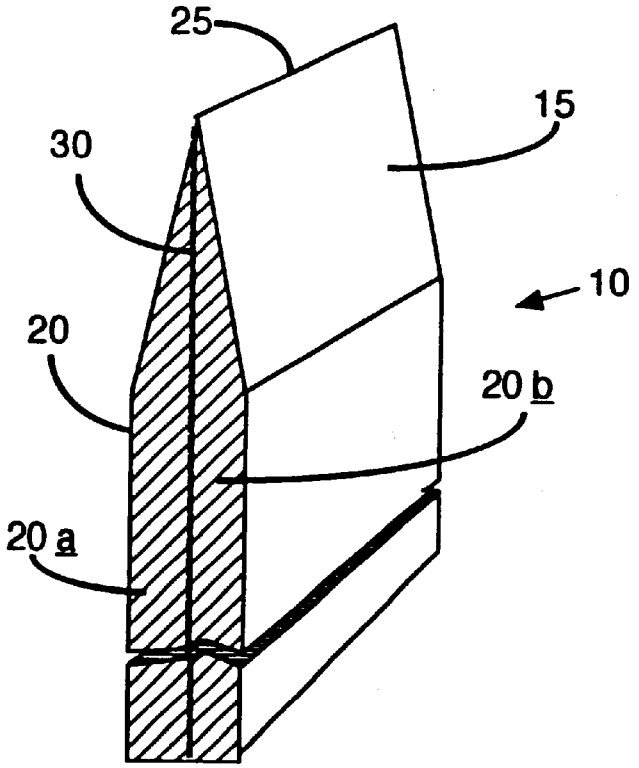
FIG. 1 is a combination perspective and cross-sectional view of a three-layer, straight edge self-sharpening blade as offered by this invention.

FIG. 1 of the appended drawings is a combination perspective and cross-sectional view of a straight edged self-sharpening blade 10 as offered by this invention. In accordance with the present invention, the blade shown in FIG. 1 has a central layer of a hard material 30 within a matrix of softer material 20. Hard material layer 30 extends within the blade lengthwise and width wise. Blade 10 is sharpened at one end creating a wedge shape 15 and exposing hard material first layer 30 at the cutting edge 25. Matrix 20 includes second and third layers 20*a* and 20*b* at opposite sides of 30.

Figure 2:
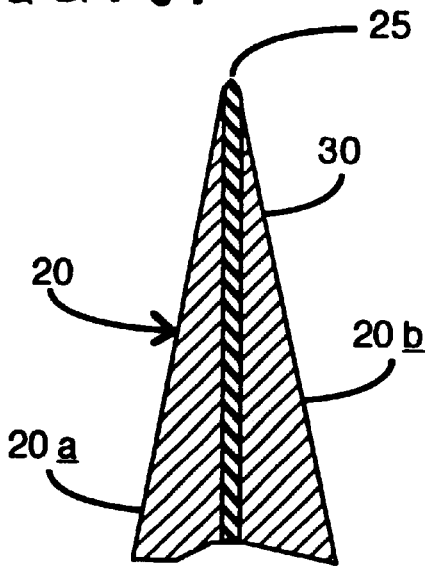
FIG. 2 is an enlarged cross-sectional view of the tip portion of the blade shown in FIG. 1.

FIG. 2 is an enlarged cross-sectional view of the tip of the self-sharpening blade shown in FIG. 1. The tip of the blade is ground to a wedge shape, exposing the central hard material layer 30 at the cutting edge 25.

Hard material 30 is selected to possess higher wear resistance in comparison with the wear resistance of softer matrix material 20. Relative difference in wear resistance of the harder material in or at the central cutting tip of the blade versus the wear resistance of the matrix material 20 that surrounds it creates a self-sharpening effect, in service. Because softer, less wear resistant matrix material 20 will wear faster than hard material layer 30 located in the center of the blade cross-section, hard material layer 30 will always be exposed at the very tip of the blade.

Additionally, in accordance with the teachings of the present invention, hard material layer 30 thickness is selected to be approximately equal to the "ultimate tip diameter", and is substantially the same everywhere within the hard layer. Thus, as the cutting edge of blade 10 wears in service, exposed hard material layer 30 at the very tip of the cutting edge will always have the ideal "ultimate tip diameter". The "ultimate tip diameter" was defined above as the tip diameter of the very tip of the wedge shaped cutting edge of a blade that performs the best in service. Experiments with conventional razor blades indicate that the best cutting action for a razor blade occurs when the tip diameter is 3,000 Angstroms or less. This means that the optimum hard layer 30 thickness of 3,000 Angstroms or less would provide the best cutting action. Because of the relative difference in wear resistances of harder 30 and softer 20 materials, normal service wear conditions would result in constant exposure of the hard material 30 at the cutting edge tip, and as a consequence of a constant and ideal cutting tip diameter, cutting action of blade 10 would always be at its optimum. Even when hard layer 30 looses material from its exposed edge due to wear, because its wear rate is slower than that of the softer, less wear resistant matrix 20, the ultimate tip diameter will be maintained and blade 10 will always exhibit ultimate sharpness and performance.

For cutting blades other than razor blades, the thickness of the central hard material layer 30 is selected to provide the optimum cutting performance specific to the selected application. For example, for kitchen knives the thickness of hard layer 30 may be less than 0.06 mm.

Figure 3:
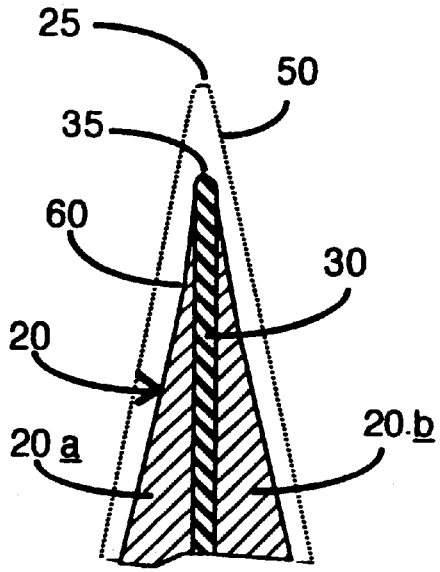
FIG. 3 is a cross-sectional view of the blade tip portion shown in FIG. 2 after being subjected to wear conditions experienced in service and associated loss of material to wear.

FIG. 3 is a cross-sectional view of a self-sharpening razor blade as offered by this invention after long time exposure to service wear. Dotted line 50 represents the original cross-sectional contour of the razor blade tip portion before any wear has taken place. Both hard material layer 30 and softer material matrix 20 wore, but loss of material is not uniform because of the wear conditions peculiar to shaving beard strands. Under idealized wear conditions that exists in beard shaving, razor blade tip shape would be expected to go toward an equilibrium shape 60 as influenced by the wear resistances of hard layer 30 and of matrix 20, and by size, hardness, and shearing mode of beard strands. Other factors may also affect the equilibrium shape and how long it takes to reach equilibrium such as use of shaving soaps, manner in which the razor is used, etc.

The resulting equilibrium tip shape 60 can be expected to remain more or less unchanged for the rest of the life of the razor and provide optimum performance without change for a much longer time than the existing conventional razor blades do. Hard material layer 30, after long time wear, may show a rounded but irregular tip shape 35 at the cutting edge. This rounding should not affect the cutting performance since the sharpness of blade 10 remains unchanged because its diameter remains constant. Rounded tip 35 has an effective diameter equal to the thickness of hard material layer 30.

Like conventional razor blades, self-sharpening razor blades of this invention may be coated with a polymer to reduce friction in shaving. However, coating of self-sharpening blades with a hard material is not advised since it will prevent the self-sharpening effect.

Figure 4:
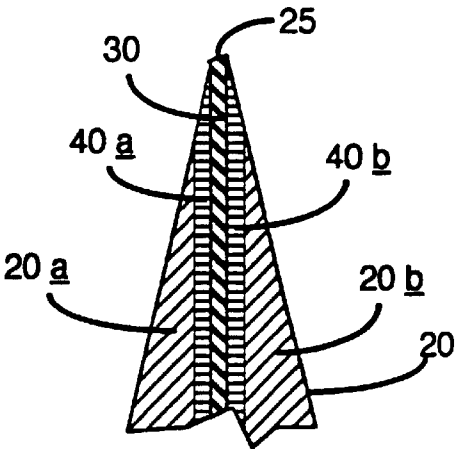
FIG. 4 is a cross-sectional view of the enlarged tip portion of a self-sharpening cutting blade constructed of five layers of materials.

Now referring to FIG. 4, where another embodiment of the present invention is shown, hard material layer 30 is sandwiched between two layers 40*a* and 40*b* of another material 40 with a wear resistance intermediate between that of hard layer 30 and that of soft matrix 20. Intermediate layers 40*a* and 40*b* can serve as a support layer or layers for hard layer 30. Similarly, there may be a multiplicity of layers at either side of hard layer 30. Each layer being less wear resistant than the one before it, as one moves away from hard material layer 30 in the center. This preserves the indicated chamfering toward tip 35.

Figure 5:
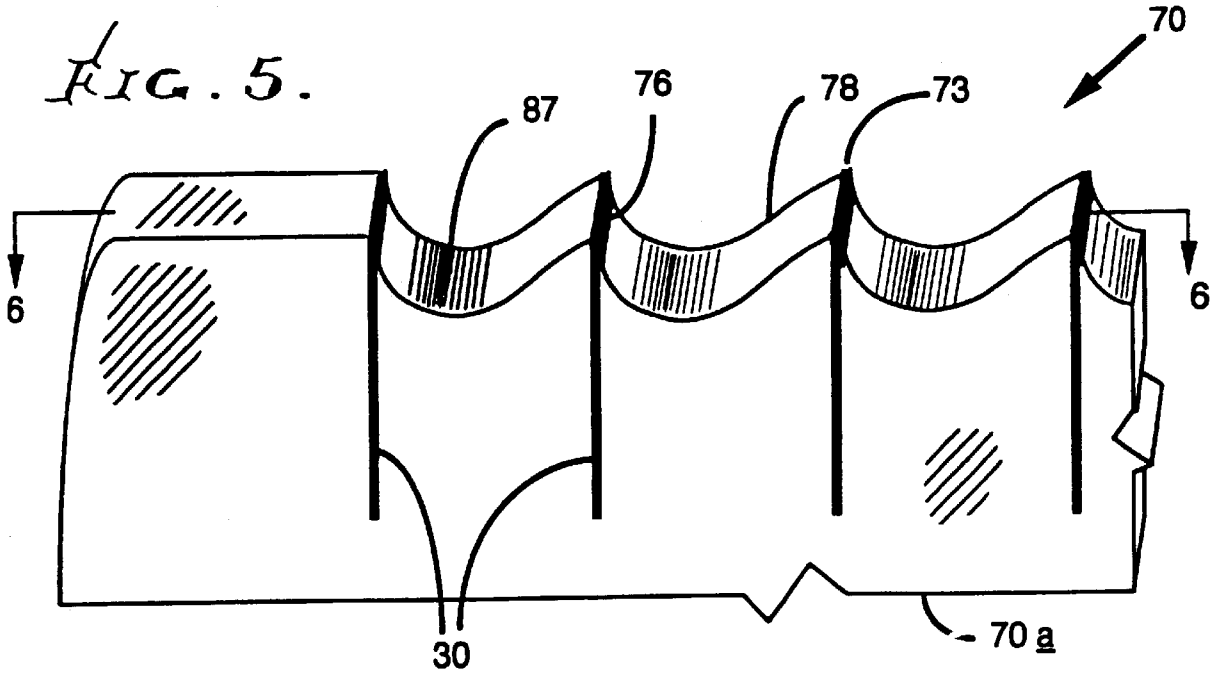
FIG. 5 is a perspective view of a portion of a self-sharpening saw blade manufactured in accordance with the present invention.

FIG. 5 is an enlarged perspective view of a portion of a hack-saw blade 70 as offered by the present invention. Here, hard material layer 30 is placed at rake surface 76 of each cutting tooth 73, and extends well into the body of saw blade 70. Saw blade 70 initially may be provided with a cutting edge profile 78 as shown in FIG. 5. Some portion of hard material layers 30 may even be exposed at rake surfaces 76. First layers 30 extend in parallel planes normal to the plane of the saw blade 70*a*.

Figure 6:
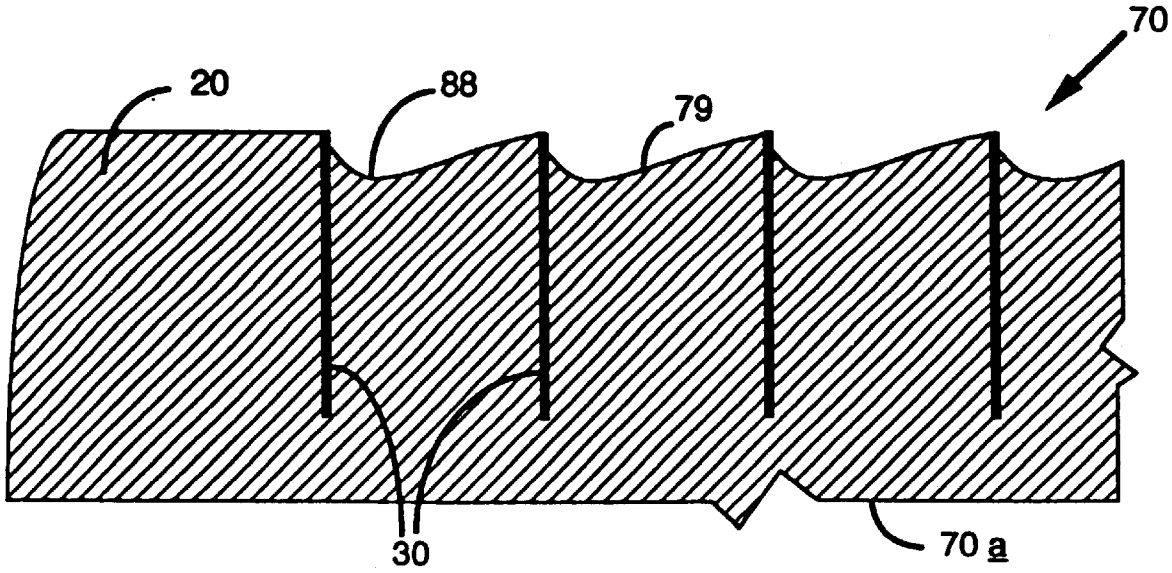
FIG. 6 is a cross-sectional view taken on the line 6—6 of FIG. 5.

As saw blade 70 is used, abrasive wear occurs and leads to loss of material from the cutting profile 78 which results in a relatively stable "equilibrium" profile 79 that is different than the initial profile as also shown in FIG. 6. After some sawing, hard material layer 30 and matrix 20 near the tips of teeth 73 wear down and initial deep crater 87 between successive teeth may become shallower. When crater 87 becomes too shallow, cutting chips are pressed by the work piece against matrix 20, and eventually cause the formation of an equilibrium crater 88 and an equilibrium profile 79 peculiar to each work piece material. After reaching equilibrium profile 79 and equilibrium crater 88, further wear of cutting teeth causes profile 79 and crater 88 to recede and expose more of hard material layer 30. This self-sharpening process substantially extends the life of saw blade 70 without any need for re-sharpening while at the same time providing near optimum cutting performance.

Selecting Blade Materials

The present invention relies upon the differences in wear rates of materials to achieve a self-sharpening effect in cutting and saw blades. Thus, there are no limits on the types of materials that can be used other than the necessity that all cutting blade and saw blade materials must be solid at typical temperatures experienced in service. This means, all engineering materials such as metals, metal alloys, carbides, nitrides, oxides, borides, diamonds, diamond-like carbons, and their mixtures, and plastics can be used to manufacture the self-sharpening cutting blades and saws offered by this invention.

To achieve the self-sharpening effect in a multi-material layer cutting blade provided by this invention, the following convention should preferably be followed:

$$(Rw)HM > (Rw)L2 > (Rw)L3 > (Rw)L4 \ldots > (Rw)Ln \qquad \text{(Eqn.1)}$$

where (Rw)HM is the wear resistance of the hard material, HM, layer (Rw)L2 is the wear resistance of the layers of material, L2, next to the both sides of the HM layer, (Rw)L3 is the wear resistance of the layers of material, L3, next to the L2 layers, (Rw)L4 is the wear resistance of the layers of material, L4, next to the L3 layers, (Rw)Ln is the wear resistance of the layers of material, Ln, next to the Ln-1 layers, where n represents the number of different material layers.

In the case of the cutting blade shown in FIGS. 1 and 2, hard, more wear resistant material layer 30 would be HM in the above formula, and softer, less wear resistant matrix material 20 would be L2. Wear resistance of materials for the cutting blade shown in FIG. 4 would be selected to obey the rule of Eqn. 1, which can be written as:

$$(Rw)HM > (Rw)L2 > (Rw)L3 \qquad \text{(Eqn. 2)}$$

where HM, L2, and L3 represent materials identified as 30, 40, and 20, respectively, in cutting blade of FIG. 4.

Figure 7:
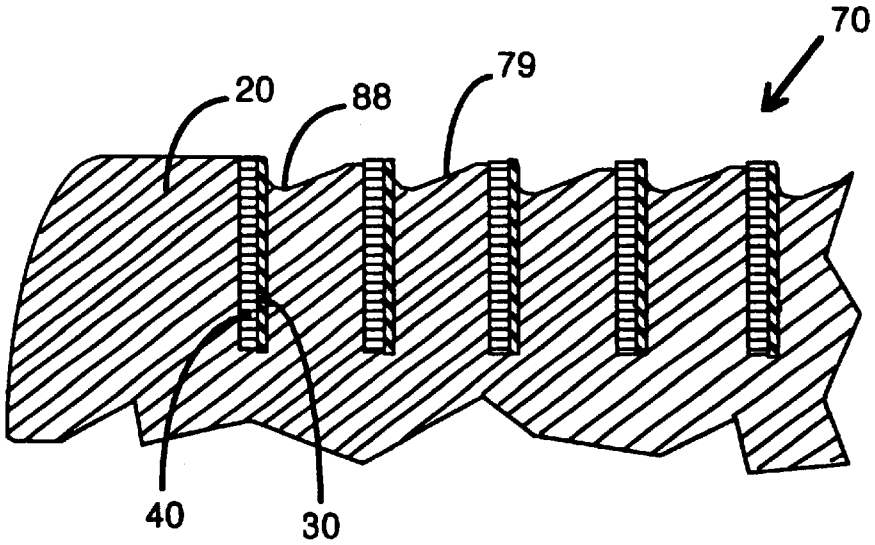
FIG. 7 is a cross-sectional view of a self-sharpening saw blade produced in accordance with this invention. In this saw blade, hard material layers are supported by layers of another material possessing wear resistance intermediate or between those of the hard material layer and matrix materials.
Figure 8A:
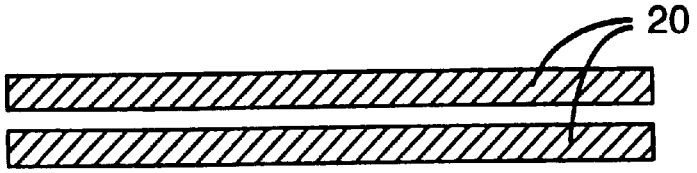
FIG. 8 shows four basic steps of a process to manufacture self-sharpening cutting blades in accordance with the invention.
Figure 8B:
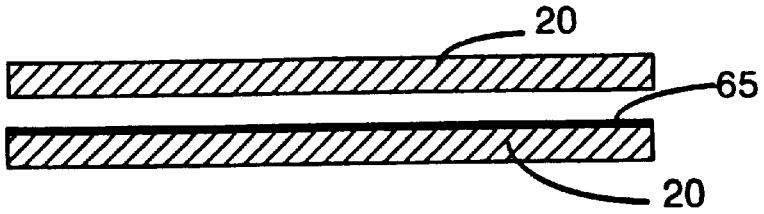
Figure 8C:
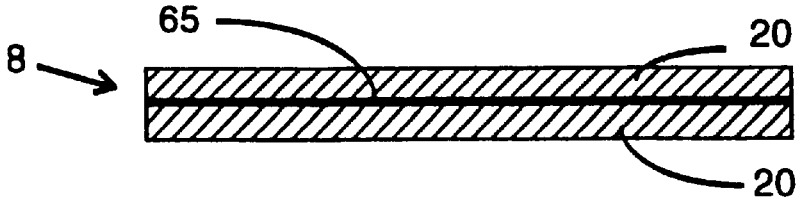
Figure 8D:
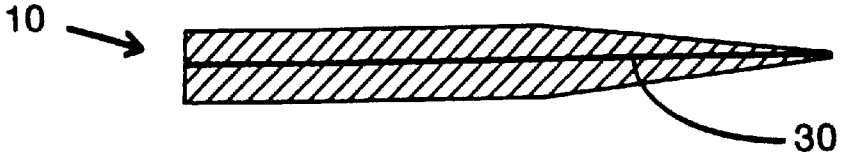
Figure 9A:
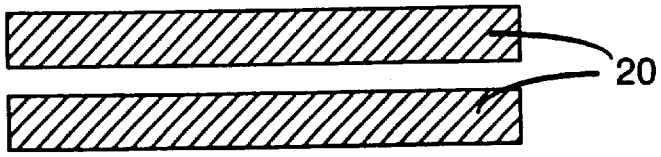
FIG. 9 shows four basic steps of another process to manufacture self-sharpening cutting blades in accordance with the invention.
Figure 9B:
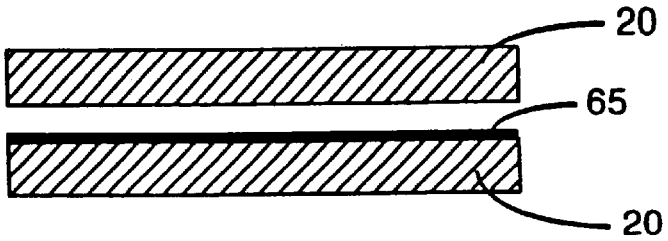
Figure 9C:
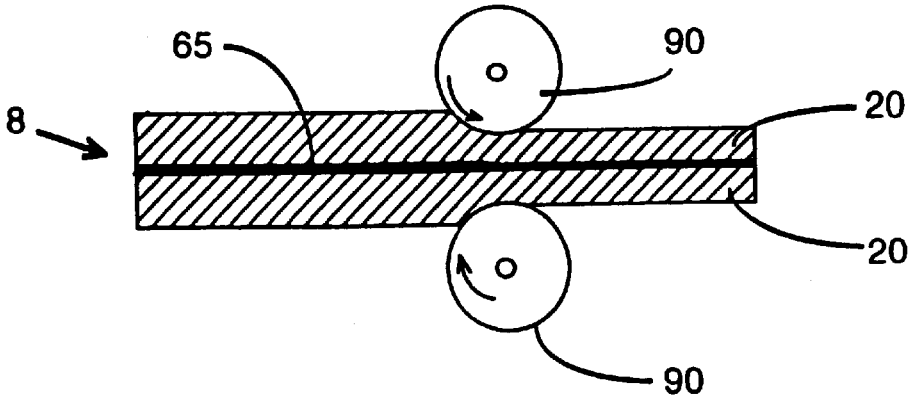
Figure 9D:
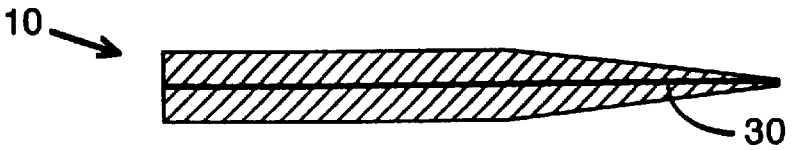

To achieve the self-sharpening effect in a multi-material layered saw blade provided by this invention, the same convention should preferably be followed. In self-sharpening saw blades of this invention, layers of materials next to HM layer need not be on both sides of HM layer except, of course, softer matrix material (L3 in the Eqn. 2 above). This is shown in FIG. 7 where next to hard material layer 30 is a back-up layer 40 within softer matrix material 20. Relative wear resistance of these three materials could again be represented by Equation 1.

Here, the term "wear resistance" is used to reflect application specific wear conditions prevalent in actual service for the self-sharpening cutting blades and the saw blades described above.

Methods and Materials for Producing Self-sharpening Blades

Referring to FIG. 8, a process is disclosed for production of self-sharpening cutting blades in accordance with this invention. The process includes Step 8-1 of starting with two clean sheets of the matrix material 20. In Step 8-2, applying a layer of materials 65 on one surface of first sheet 20, materials of layer 65 are selected to possess more resistance to wear than that of matrix material sheets 20 after cutting blade 10 is manufactured and material layer 65 in FIG. 8 becomes hard material layer 30 of FIGS. 1 and 2. Step 8-3 involves bonding all layers together to form a laminate 8 of materials layer 65 between softer matrix material sheets 20. In Step 8-4, laminate 8 is cut to the desired blade shape and sharpened at one or more edges to the desired wedge or chamfer angle similar to the blade 10 shown in FIG. 1. The process of FIG. 8 may be used to produce razor blades, cutting knives, rotary blades, axes, agricultural blades, chisels and other types of cutting blades.

In another embodiment of this invention, matrix material sheets 20 in Step 8-1 of FIG. 8 are plastic i.e. synthetic resin materials. Plastic matrix materials used in cutting blades may be selected for their lubricity, water absorption, and rigidity as well as their wear properties.

In Step 8-2 of FIG. 8, a hard material layer 65 may be deposited on first plastic matrix sheet 20 as a coating of a metal, metal alloy, an oxide, a carbide, a nitride, a boride, diamond, diamond like carbon, and their composites, or may be placed on top of first matrix sheet 20 as a sheet or film of a hard material 65. Some of the specific hard materials include metals, such as chromium, metal alloys such as tool steels, stainless steels and carbon steels, all types of hard and super-hard materials such as alumina, titanium carbide, zirconium carbide, boron nitride, titanium nitride, tungsten carbide, silicon carbide, diamond, diamond-like carbon, their mixtures and composites, and other compounds known for their high hardness.

Coating deposition methods for plastic substrates include physical vapor deposition methods suitable for low-temperature deposition, such as low-temperature arc vapor deposition, ion plating, and sputter coating. These are commonly practiced methods in the coating industry. The choice of hard material sheet thickness, or coating deposition method and its thickness would depend on the type of blade being produced. For blades like razor blades that require very thin hard material layers of 3000 Angstroms or less in thickness, with uniform thickness, precision coating deposition methods such as sputter coating methods would be the methods of choice.

In Step 8-3 of FIG. 8, second matrix sheet 20 would be placed on first matrix sheet 20, positioning material layer 65 in between two plastic matrix sheets 20. The assembly thus formed would be bonded to form laminate 8. Bonding process to create laminate 8 would depend on the type of plastic material used as matrix sheets 20: thermoplastic or thermosetting. Thermoplastic materials soften when heated and re-harden when cooled.

Thermoplastics may be heated and joined by any one of the commercially available methods such as ultrasonic welding, spin welding, and linear friction welding. Additionally, there are a number of external heating and pressing methods available for bonding of these materials to each other and to secondary materials. External heating and pressing methods include hot-plate welding, hot-gas and extrusion welding, and radio frequency or dielectric welding. These and other welding processes for plastics are described in an article by Robert A. Grim in Advanced Materials and Processes, Mar. 1995, pp. 27–30. Plastic adhesives may also be used to bond material layer 65 to matrix material for bonding of plastics.

Thermosetting resins too may be used as the softer matrix sheets 20. These resins start out as liquid, but may be cured to a solid, infusible sheet using methodology well known to those in the field. Bonding stage of the process in Step 8-3 shown in FIG. 8 may simply incorporate application of the same or a different liquid resin as second matrix sheet 20 onto the already cured (or in the process of being cured) first matrix sheet 20 one surface of which is already covered with material layer 65 containing hard material in the form of sheet, insert, film, powder layer, or coating, and in situ curing second matrix sheet 20.

In final Step 8-4 of FIG. 8, laminate 8 produced as described above is cut to desired blade 10 shape and sharpened. Cutting and sharpening may be accomplished by any of the conventional cutting and sharpening methods. Methods of cutting and sharpening are selected to accommodate the properties of the laminated blade materials, intended application, and surface finish requirements.

In another embodiment of this invention, matrix material sheets 20 in Step 9-1 of FIG. 9 are malleable metal or a malleable metal alloy in wrought or partially sintered (porous) powder metallurgy produced sheet form. These materials are selected for their formability, rigidity, wear, and corrosion properties. Matrix sheets 20 and hard material layer 65 are initially thicker than the final desired thickness to allow for reduction in thickness that takes place later in Step 9-3.

In Step 9-2 of FIG. 9, hard material layer 65 is a sheet of a malleable metal, or a malleable metal alloy, or a layer of powder containing one or more of the following types of material powder particles such as metals, metal alloys, oxides, carbides, nitrides, borides, minerals, diamond, diamond-like carbon powders, and their mixtures, carbon (graphite), boron, and powders of a softer material such as material of matrix sheets 20. Carbide, nitride, and,oxide types include alumina, titania, zirconia, titanium carbide, zirconium carbide, boron nitride, titanium nitride, tungsten carbide, silicon carbide, and their mixtures. If hard material layer 65 is a sheet of a metal or a metal alloy, that sheet is placed on one surface of first matrix sheet 20 and second matrix sheet 20 is placed on top of hard material sheet 65 in preparation for bonding step, Step 9-3. If material layer 65 is a mass of powder, it may be applied on one surface of first matrix sheet 20 as a slurry or a paste in a fugitive binder such as cellulose acetate and acetone mixture, or may be sprayed using a fugitive liquid carrier such as alcohol to form a uniform layer, and second matrix sheet 20 is placed on top of material layer 65, heated to a temperature to evaporate the fugitive compounds in preparation for bonding step, Step 9-3.

Step 9-3 involves pressure bonding all layers together to form a laminate 8 of hard material layer 65 between softer matrix material sheets 20. Pressure bonding may be accomplished by rolling as shown in FIG. 9 Step 9-3 or by pressing to both bond all materials together to form a laminate 8, and to reduce laminate thickness simultaneously. Pressure bonding methods create strong metallurgical bonds between all components of laminate 8. In FIG. 9, the bonding process shown involves rolling which takes place under very high pressures, before rolling. However, if pressure bonding is done by pressing, matrix sheets 20, and layer 65 may have to be heated in a non-oxidizing or reducing atmosphere to prevent oxidation of the materials that form laminate 8. Non-oxidizing and reducing atmospheres are well defined by metallurgists in the metals heat treating field. Pressure bonding using rolling mills and presses is a well practiced commercial process by which a strong metallurgical bond between hard 30 and matrix 20 material layers of the cutting blade shown in FIG. 1 can be achieved.

In final step 9-4 of FIG. 9, laminate 8 produced as described above is cut to desired blade 10 shape and sharpened. Cutting and sharpening may be accomplished by any of the conventional cutting and sharpening methods. Methods of cutting and sharpening are selected to accommodate the properties of the laminated blade materials, intended application, and surface finish requirements.

Referring again to FIG. 8, another embodiment of this invention is offered. While matrix sheets 20 can be any metal, metal alloy, ceramic, composite, and like material, material layer 65 is a hard material insert with desired thickness and shape or a hard material deposit with desired thickness and shape. That hard material insert or hard material deposit may be a metal, metal alloy, ceramic, or a cermet of hard particles of carbides, oxides, nitrides, borides, diamond, diamond-like carbon powders bonded and held together by a metal or an alloy, or a composite of these materials. Referring to FIG. 8, in Step 8-2 insert or hard material deposit 65 would be placed between matrix sheets 20, and in Step 8-3 bonded to sheets 20. Conventional bonding processes of brazing, diffusion bonding with or without an interface bonding aid, and pressure bonding with or without an interface bonding aid can be used for the bonding step. In final Step 8-4 of FIG. 8, laminate 8 is cut to desired blade 10 shape and sharpened.

In another embodiment of this invention, hard material layer 30 is reaction hardened by heat treating laminate 8 after Step 8-3 or blade 10 after Step 8-4 shown in FIG. 8, or Step 9-3 or blade 10 after Step 9-4 shown in FIG. 9. In this embodiment, material layer 65 contains one or more of the elemental constituents of hard carbides and borides. Elemental constituents of hard carbides and borides include C, B, Zr, Ti, Al, Ta, W, Cr, Si, V, Nb, and one or more of them may initially be applied on first matrix sheet 20 as powder by dipping, spraying, or deposited as a discrete layer by any one of the vapor deposition processes. When laminate 8 or blade 10 with material layer 65 containing elemental carbon or boron is heated to a pre-selected temperature and held at that temperature for a pre-determined time period, carbon and/or boron would diffuse and react with metallic elements, available near joint surfaces of matrix sheets 20 or within material layer 65, to form thermodynamically stable hard carbide or boride compounds. If carbon and boron are present simultaneously, they may react to form boron carbide which is another hard substance. Thus, a layer containing a dense population of hard, wear resistant particles (carbides and/or borides) is created within layer 65 or at or near the joined surfaces of matrix sheets 20. As part of a cutting blade, this reaction hardened layer 65 becomes wear resistant layer 30 of blade 10 in FIGS. 1, 2, and 8, and self-sharpen in service.

Additionally, carbon or boron may be in solid solution within matrix sheets 20, and carbide or boride forming metallic elements may be a part of material layer 65. When such laminate 8 is subjected to a pre-selected heat treatment, carbon or boron would diffuse to carbide or boride forming metallic elements, and react with them to form hard carbide or boride particles.

In another embodiment of this invention, material layer 65 in processes of FIGS. 8 and 9 is hardened by diffusion hardening to form a fine dispersion of hard oxide and/or nitride particles. Diffusion hardening is achieved by allowing selected gases to react with and diffuse into laminate 8 at a selected elevated temperature after Step 8-3 (FIG. 8) or Step 9-3 (FIG. 9). If the gas is a nitrogen containing gas such as ammonia, and material layer 65 contains one or more of hard nitride forming metallic elements such as Ti, Si, Zr, Cr, V, Al, a fine dispersion of nitride particles would form within layer 65 increasing its hardness and wear resistance. If the gas is an oxygen containing gas, and material layer 65 contains one or more of hard oxide forming metallic elements, such as Ti, Si, Zr, Cr, V, Al, Ta, Nb, a fine dispersion of oxide particles would form through internal oxidation within layer 65 increasing its hardness and wear resistance. Thus, a layer containing dense population of hard, wear resistant particles (nitrides and/or oxides) is created within layer 65 or at or near the joined surfaces of matrix sheets 20. As part of a cutting blade, this reaction formed, hardened layer becomes wear resistant layer 30 of blade 10 in FIGS. 1, 2, 8, and 9, and self-sharpen in service.

Material layer 65 in processes of FIGS. 8 and 9 may also be hardened by diffusion hardening to form a fine dispersion of hard oxide by reduction of metal oxides of lower thermodynamic stability and formation of stable oxides. This type of hardening of material layer 65 may take place if layer 65 initially contains lower stability oxides and metallic elements with high tendency to form thermodynamically stable, hard oxides. When such a laminate 8 is heated to a selected temperature and held at that temperature for a pre-determined length of time, stable oxide forming, highly reactive metallic elements such as Zr, Ti, Al, Ta, Cr, V would reduce lower stability oxides such as oxides of Fe, Cu, and Ni, and combine with the freed oxygen to form their more stable oxide particles.

Forming hard compound particles in a cutting blade by diffusion and solid state chemical reactions creates a hard material layer 30 with diffused boundaries. Hard material layer with diffused boundaries may be preferred for some applications from both performance and ease of manufacturing points of view.

Yet another embodiment of the present invention is a variation of the process shown in FIG. 9 which is a process of manufacturing self-sharpening cutting blades in accordance with the teachings of this invention. This process starts with wrought, or pressed and partially sintered (porous) steel matrix sheets 20 (Step 9-1), and a carbon rich steel layer 65 (Step 9-2). Steel matrix 20 may be a carbon steel, low alloy steel, tool steel, or a stainless steel. Carbon rich steel layer 65 is preferred to have a carbon content above that of steel matrix sheets 20. Carbon rich steel layer 65 may be a loosely held together powder mass, a pressed and partially sintered powder sheet, or a wrought sheet. Steel layer 65 may have a chemical composition similar to known compositions of carbon steels, low alloy steels, tool steels, and martensitic stainless steels all with carbon contents more than the carbon content of steel matrix sheets 20. Carbon rich steel powder layer 65 can be applied on one surface of first matrix steel sheet 20 by spraying or dipping using a fugitive binder such as alcohol or acetone as a carrier. If carbon rich layer 65 is a wrought or pressed and partially sintered steel sheet, it would simply be placed on first steel sheet 20. In Step 9-3, matrix steel sheets 20 are pressure bonded together with carbon rich steel layer 65 remaining between sheets 20. Pressure bonding may be accomplished by rolling as shown in FIG. 9 Step 9-3 or by pressing to both bond all materials together to form a laminate 8, and to reduce laminate thickness simultaneously. Pressure bonding methods create strong metallurgical bonds between all components of laminate 8. In FIG. 9, the bonding process is accomplished by rolling under very high pressures, so that, the laminate 8 may not need to be heated for proper bonding to take place. However, if pressure bonding is done by pressing, matrix steel sheets 20, and layer 65 may have to be heated, and a non-oxidizing or reducing atmosphere may then be necessary as a protective atmosphere to prevent oxidation of the materials that form laminate 8. Non-oxidizing and reducing atmospheres are well defined by metallurgists in the metals heat treating field.

Pressure bonding using rolling mills is a well practiced commercial process by which a strong metallurgical bond between hard 30 and matrix 20 material layers of the cutting blade shown in FIGS. 1, 2, and 9 can be achieved.

After laminate 8 is rolled or pressed to the desired thickness, it is heated to a temperature within the austenite range of carbon rich steel layer 65, and rapidly cooled to transform microstructure of carbon rich steel layer 65 into martensite. Martensite is a very hard structure. Its hardness increases as the carbon content increases. Laminate 8 may then be given a tempering treatment to remove residual stresses and to increase ductility and toughness. This results in a laminate 8 with a hard steel layer 30 within a relatively softer and less wear resistant matrix steel 20. Laminate 8 may then be cut to desired cutting blade shape and sharpened at desired edges to create a self-sharpening cutting blade similar to blade 10 of FIGS. 1, 2, and 9, Step 9-4.

Another embodiment of the present invention is a process similar to the process of manufacturing self-sharpening cutting blades shown in FIG. 9. In this process, material layer 65 in Step 9-2 is a substantially uniform mixture of steel powder and carbon (graphite) powder. That steel and graphite powder mixture may be a loosely held together powder mass or a pressed and partially sintered powder sheet. Steel powder in the powder mixture may have a chemical composition similar to known compositions of carbon steels, low alloy steels, tool steels, and martensitic stainless steels. Other steps of the process are outlined in FIG. 9 and remain the same. This variation of the process of FIG. 9 allows carbon content of hard material layer 30 in blade of FIG. 9 to be much higher than possible in wrought steels including tool steels. As stated above, high carbon content means higher hardness and wear resistance which extends the service life of self-sharpening cutting blades even further.

Figure 10:
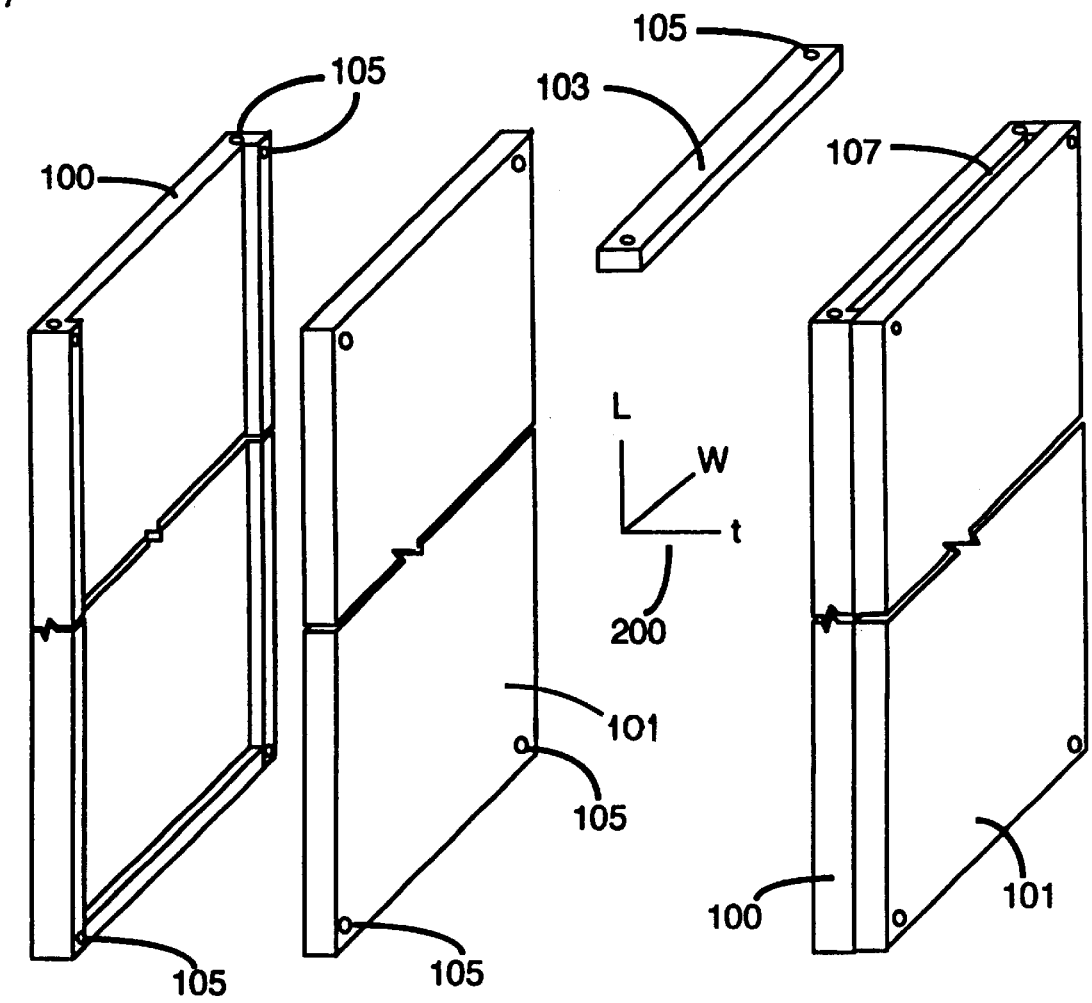
FIG. 10 shows perspective views of the components of a heat resistant die and an assembled die used to manufacture self-sharpening saw blades in accordance with the invention.

In FIGS. 10 through 16, the basic steps of a process of manufacturing self-sharpening saw blades in accordance with this invention are shown. Referring to FIG. 10, a heat resistant die set consisting of die 100, die face cover 101, and side cover 103, has a (hollow) cavity 107. Die cavity 107 has a thickness and length substantially equal to thickness and length, respectively, of saw blades being manufactured. Width of die cavity 107 may be a multiple of the width of the saw blades being manufactured. In FIG. 10, directions 200 L, W, and t represent directions of length, width, and thickness, respectively, of die cavity.

Figure 11:
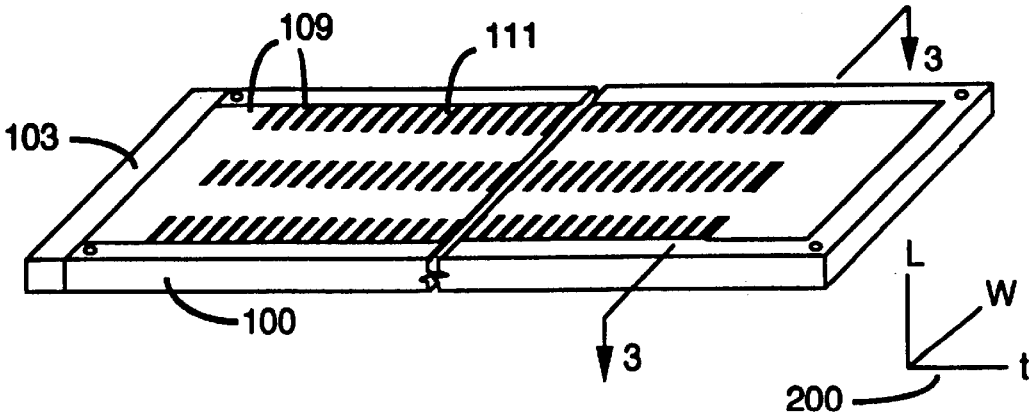
FIG. 11 is a perspective view showing a stage in the process of making saw blades, wherein an opened die cavity filled with stripes of hard material powder within matrix material powder is ready to accept infiltrant material.
Figure 12:
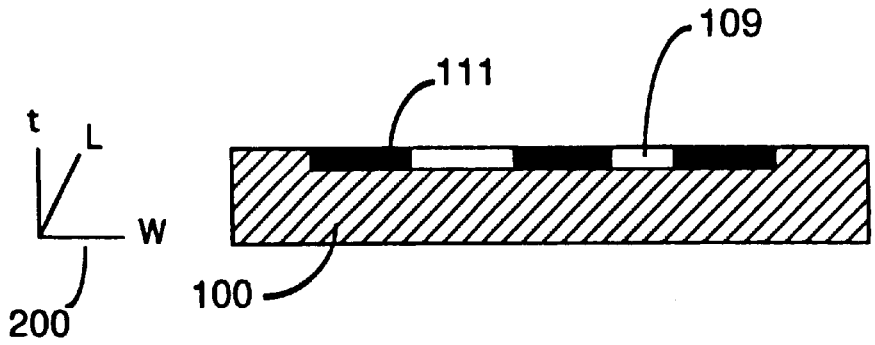
FIG. 12 is a cross-sectional view taken on the line 3—3 of FIG. 11.

With face cover 101 attached to die 100 with screws 105, and side cover 103 being off, die cavity 107 is alternatively filled with layers of matrix material powder 109 and hard material powder 111. For a die cavity 107 designed to produce multiples of blades at once, matrix material powder 109 is poured into cavity 107 in a manner and amount to form a desired distance between stripes of hard material powder 111. Hard material powder 111 is poured into die cavity 107 in a manner and amount to form stripes of hard material powder 111 in pre-determined dimensions. After die cavity 107 is filled, side cover 103 is screwed on die 100, and powder filled die 100 is laid on its face, leaving face cover 101 facing up. Face cover 101 is then removed to expose powder mass as shown in FIG. 11. In FIG. 11, hard material powder 111 is seen as dark stripes separated by matrix material powder 109. A cross-section of die 100 and powders 109 and 111 within plane represented by line 3—3 in FIG. 11 is shown in FIG. 12.

Figure 13:
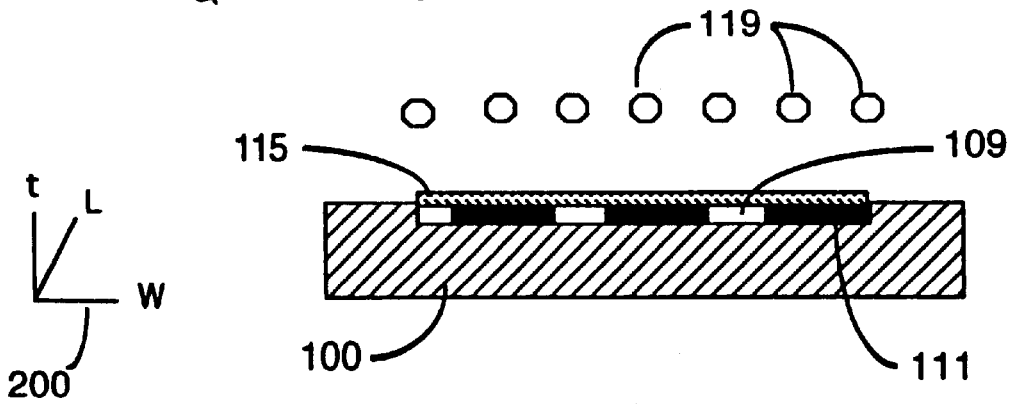
FIG. 13 is a cross-sectional view showing a stage in the process of making saw blades, wherein a layer of infiltrant material has been placed over the powder in die cavity, and the assembly heated to allow infiltration.
Figure 14:
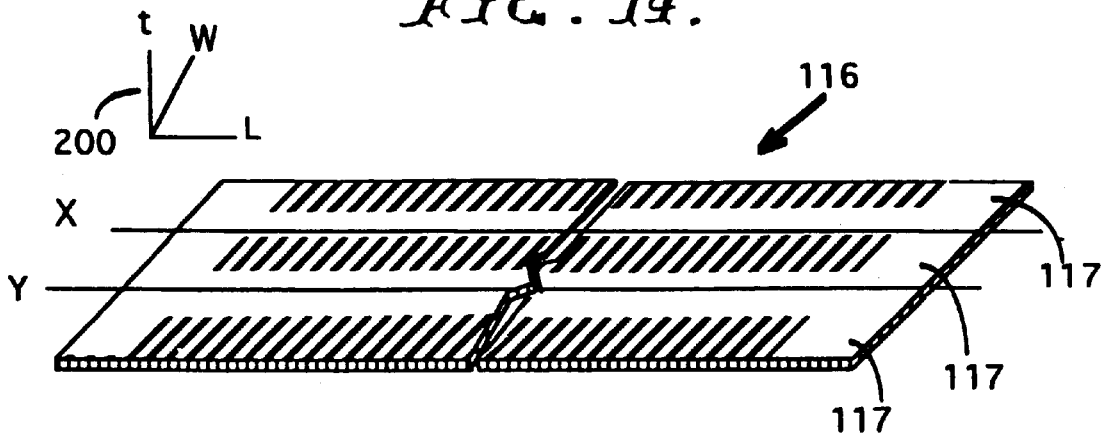
FIG. 14 is a perspective view showing another stage in the process of making saw blades, wherein a solidified sheet of infiltrated powders is cut along lines X and Y to produce three saw blade blanks.
Figure 15:
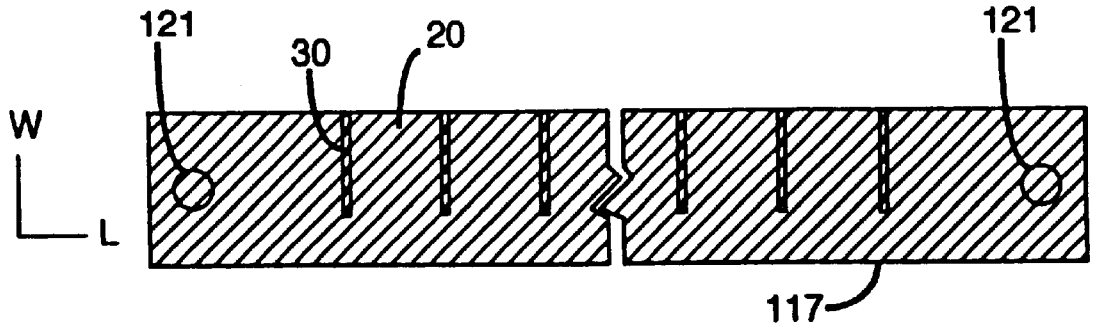
FIG. 15 is a cross-sectional view of a saw blade blank.

In the next step shown in FIG. 13, powder mass within die 100 is covered with a layer of infiltrant material 115. Amount of infiltrant material 115, is pre-determined to be sufficient to substantially fill all space between particles of powders 109 and 111. Die 100, side cover 103, die cavity 107 filled with powders of 109 and 111, and infiltrant 115 form an assembly which is heated through heating elements 119 to a pre-selected infiltration temperature at which infiltrant material 115 melts and infiltrates into powders 109 and 111, filling substantially all space between particles of powders 109 and 111. Heating may take place within a protective atmosphere to prevent oxidation of powders 109, 111, and infiltrant 115. Upon cooling to room temperature, infiltrated powders become a solid sheet 116, and is removed from die 100 (FIG. 14). Solid sheet 116 is sheared or cut along lines X and Y shown in FIG. 14, producing, in this case, three saw-blade blanks 117.

Figure 16:
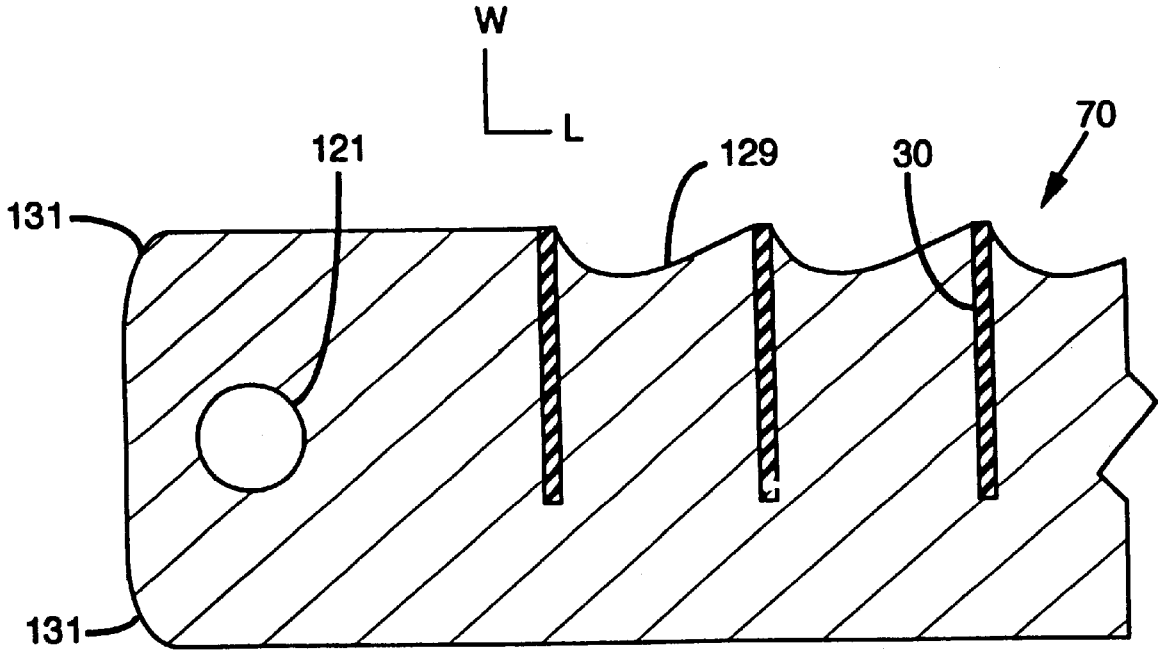
FIG. 16 is an enlarged cross-sectional view showing the final stage in the process of making saw blades, wherein a cutting profile is formed.

In the next step of this process, blanks 117 are drilled to create mounting holes 121 (FIG. 15), and corners 131 of blanks 117 are rounded, and an initial sawing profile 129 may be ground between hard material strips 30 as shown in FIG. 16 to create self-sharpening saw blade 70.

Matrix material 109 may be any one or more of the metals, metal alloys, oxides, borides, carbides, or composites containing fibers or whiskers. Hard material 111 may be metals, metal alloys, carbides, oxides, nitrides, borides, diamond, and diamond-like carbon. Wear resistance of hard material 111 is selected to be higher than that of matrix material 109.

Infiltrant material 115 may be a plastic, a metal, or a metal alloy with a melting point below those of powders 109 and 111. High fluidity in the liquid state is desirable. If infiltrant material is a liquid resin, infiltration of powders 109 and 111 by infiltrant 115 can take place at or near room temperature. However, after infiltration, infiltrated powders 109 and 111 may be heated to accelerate curing of resin infiltrant 115.

Die set materials include block graphite, high-temperature metals and metal alloys such as molybdenum, tungsten, and Inconels 738, 625, 718, and ceramics like alumina, zirconia, silica, ceramic composites, and refractory carbides. Prior to powder filling, inside walls of die cavity 107 may be sprayed with a mold parting compound such as powdered graphite and boron nitride within a fugitive carrier such as alcohol or acetone.

In another embodiment of this invention, process of FIGS. 10–16, may be carried out by substituting solid hard material inserts in place of hard material powder strips.

Another embodiment of the invention involves cold-pressing of powders 109 and 111 while in die cavity 107, followed by the infiltration process as shown in FIG. 13 to produce saw blades 70.

Yet another embodiment of the invention includes cold-pressing of powders 109 and 111 while in die cavity 107, followed by partial sintering before the infiltration process takes place as shown in FIG. 13. Cold-pressed or cold-pressed and sintered powder skeleton should consist of a network of solid particles providing interconnected pores and channels of a size range that permits unimpeded capillary force action.

EXAMPLE 1

To manufacture self-sharpening cutting blades, two sheets of wrought AISI (American Iron and Steel Institute) type 1010 carbon steel measuring 4.0 mm×50 mm×180 mm, and a sheet of 1095 carbon steel, measuring 0.2 mm×50 mm×180 mm were cleaned thoroughly by grit blasting, immersion in a hydrochloric acid solution, and wiping with an alcohol dipped cloth. The three sheets were then stacked to create a sandwich like assembly with the 1095 steel being in the middle. Corners of the assembly were tack welded for ease of handling and proper alignment during rolling. The 1010-1095-1010 carbon steel stack was cold rolled with several intermediate anneals to a thickness of 0.38 mm. The initial cold roll pass reduced the overall thickness of the stacked assembly by about 60%, and created a strong metallurgical bond between the three carbon steel sheets. In subsequent roll passes, reductions in thickness were less than the initial pass. Several knife blades were cut from the resultant elongated laminate, and heat treated by heating to 850° C. and holding for ten minutes, water quenching and tempering at 290° C. for two hours. Handles were then mounted, blades polished, and one edge of the blades were sharpened to a wedge angle of about 25 degrees. After a knife thus produced was subjected to extensive wear by cutting wood and examined under a microscope it was evident that the middle layer of hard steel (1095 steel) was instrumental in maintaining the sharpness of the knife. This (hard material) layer which was about 0.004 mm in thickness provided continued sharpness for the cutting application for which it was used. Even after 3 months of use in a variety of severe cutting applications, this knife did not need any sharpening.

AISI 1010 and 1095 carbon steels were chosen for the blades used in this experiment because these materials are readily available, low cost, and have historically been used for knives. Furthermore, hardness of hardened and tempered 1095 steel is nearly three times that of hot hardened 1010 steel (60 Rc versus 23 Rc). And hardness, in this case, substantially determines wear resistance against sliding and abrasive wear.

EXAMPLE 2

Two cold pressed compacts of AISI type 410 stainless steel powder measuring 3.2 mm×76 mm diameter, obtained from Cavity Masters Corporation, Franklin, Ill. were cleaned by dry abrasion with a silicon carbide 600 grit paper. Density of the powder compacts was 6.6 g/cc which is about 82% of the material's theoretical density. An approximately 0.2 mm thick layer of 50% diamond powder and 50% by volume 410 stainless steel powder mixture was applied on one face of the first compact using alcohol as a fugitive carrier. Diamond powder was a −325+400 mesh natural diamond with a trade identification of PDA 665 obtained from Diamond Abrasives Corporation, New York, N.Y. PDA 665 particles are blocky, well shaped particles that are heat resistant up to 1200° C. The second powder compact was placed on the first compact leaving the diamond—410 powder layer in between the two compacts. Two compacts were attached together for ease of handling using three steel spring clamps. Two faces of the clamped assembly was sprayed with boron nitride powder in alcohol mixture to act as a parting compound during pressing. The assembly was put in a 304 stainless steel can. Can was welded all around to create an air tight container, and the air inside the container was evacuated through a tube welded to the side of the container using a mechanical vacuum pump. When the container pressure reached less than 10 $\mu$m of mercury, the evacuation tube was welded to entirely close the container. The container and its content was heated to 1100° C. and was pressed under a pressure of 690 Mpa. Pressure was maintained for about 10 seconds and then released. Upon cooling, the stainless steel container was removed and the laminate thus formed was cold rolled to a thickness of 1.3 mm. A circular blade with a diameter of 120 mm was cut from the cold rolled laminate, austenetized 30 minutes at 925° C., water quenched, and tempered for 1 hour at 500° C., polished, and outer edge of the blade was sharpened to a wedge angle of about 30 degrees. The circular blade thus produced was subjected to extensive wear by cutting variety of steels, superalloys, and concrete. An examination revealed that the diamond powder containing middle layer, measuring about 0.1 mm in thickness, was always exposed and this layer determined the sharpness of the circular blade. Cutting performance of the blade was not affected with length of time of use. Related self-sharpening effect was also observed.

Diamond is the hardest, most wear resistant substance known. Its use as part of a hard layer within a softer less wear resistant matrix of 410 stainless steel may not have represented the optimum material combination for self-sharpening effect to occur and produce the longest possible blade life. However, the experiment demonstrated the feasibility of its use as a wear resistant cutting edge material that could produce a self-sharpening effect under severe wear conditions.

EXAMPLE 3

Two cold pressed compacts of AISI type 304 stainless steel powder measuring 6.4 mm×76 mm diameter, obtained from Cavity Masters Corporation, Franklin, Ill. were cleaned by dry abrading with a silicon carbide 600 grit paper. Density of the powder compacts was 6.6 g/cc which is about 82% of the material's theoretical density. An approximately 0.2 mm thick layer of W—4.1% C—12.7% Co, 15% Fe (by weight) powder was applied on one face of the first compact using alcohol as a fugitive carrier. Much of the tungsten powder was combined with carbon in the form of WC. Powder particle size was −100 mesh. The second powder compact was placed on the first compact leaving the WC rich powder layer in between the two compacts. Two compacts were attached together temporarily for ease of handling using three steel spring clamps. Two faces of the clamped assembly were sprayed with boron nitride powder in alcohol mixture which would act as a parting compound during pressing. The assembly was put in a 304 stainless steel can. The can was welded all around to create an air tight container, and the air inside the container was evacuated through a tube welded to the side of the container using a mechanical vacuum pump. When the container pressure reached less than 10 $\mu$m of mercury, the evacuation tube was welded to entirely close the container. The container and its content was heated to 1100° C. and was pressed under a pressure of 690 Mpa. Pressure was maintained for about 10 seconds and then released. Upon cooling, the stainless steel container was removed and the laminate thus formed was cold rolled to a thickness of 1 mm. A circular blade with a diameter of 120 mm was cut from the cold rolled laminate, polished, and outer edge of the blade was sharpened to a wedge angle of about 30 degrees. The circular blade thus produced was subjected to extensive wear by cutting a variety of steels and superalloys. An examination revealed that the WC powder containing middle layer, measuring about 0.02 mm in thickness, was always exposed and this layer determined the sharpness of the circular blade. Cutting performance of the blade was not affected with length of time of use, and self-sharpening effect was evident.

EXAMPLE 4

Two cold pressed compacts of AISI type 304 stainless steel powder measuring 3.2 mm×76 mm diameter, obtained from Cavity Masters Corporation, Franklin, Ill. were cleaned by dry abrading with a silicon carbide 600 grit paper. Density of the powder compacts was 6.6 g/cc which is about 85% of the material's theoretical density. An approximately 0.1 mm thick layer of a powder mixture of W, 20% Fe, and 4.5% by weight C was applied on one face of the first compact using alcohol as a fugitive carrier. Tungsten powder particle size was −325 mesh, and the carbon powder used was synthetic graphite grade SF-39 from Superior Graphite, Chicago, Ill., with a particle size of less than 10 μm. The second powder compact was placed on the first compact leaving the tungsten and carbon powder layer in between the two compacts. Two compacts were attached together temporarily for ease of handling using three steel spring clamps. Two faces of the clamped assembly was sprayed with boron nitride powder in alcohol mixture which would act as a parting compound during pressing. The assembly was put in a 304 stainless steel can. Can was welded all around to create an air tight container, and the air inside the container using a mechanical vacuum pump. When the container pressure reached less than 10 μm of mercury, the evacuation tube was welded to entirely close the container. The container and its content was heated to 1100° C. and was pressed under a pressure of 690 Mpa. Pressure was maintained for about 5 minutes to allow some diffusion bonding to take place, and then released. Upon cooling, the stainless steel container was removed and the laminate thus formed was cold intermediate anneals to a thickness of 0.16 mm. Several cutting blades were cut from the hot rolled laminate and were heated to 1200° C. and held at that temperature for two hours to promote the formation of tungsten carbide (WC) and thus a thin layer hard material within a matrix of relatively softer and less wear resistant 304 stainless steel was formed. Later, handles were mounted, blades were polished, and one edge of the blades was sharpened to a wedge angle of about 25 degrees. A knife thus produced and subjected to extensive wear by cutting paper stacks and wood showed self-sharpening effect and the blade performance did not deteriorate with time.

EXAMPLE 5

A sheet of acrylonitrile-butadiene-styrene (ABS) measuring 2 mm×10 mm×50 mm was metallized by electroless coating first by copper, then by nickel, and finally by chromium with a total thickness of about 0.8 μm. The piece was then coated with a 2 μm thick zirconium nitride (ZrN) low-temperature arc vapor deposition process at Vapor Technologies, Inc., Boulder, Colo. This was followed by electroless deposition of chromium, nickel, and copper with a total thickness of 0.8 μm. The piece was then bonded to another piece of ABS with similar dimensions as the first piece by using a clear epoxy resin adhesive manufactured by Devcon Consumer Products, Des Plaines, Ill. A strong bond was obtained after curing at 85° C. for eight hours. The laminated blade thus produced was sharpened at one edge to an angle of 30 degrees and used for cutting experiments on stacks of paper. It performed well. While the sharpness of the blade did not diminish with extended use, wear rate of ABS (matrix material) was considered too high in comparison with the wear rate of the ZrN coating layer (hard layer) leaving the ZrN layer unsupported at the cutting edge. This problem can be resolved by increasing the wear resistance of the matrix material by either choosing a plastic that possesses higher wear resistance, such as Acetal and Polysulfone, or by modifying the basic ABS composition by additives like silicone and PTFE. The thickness of ZrN may also be reduced to accomplish the same.

EXAMPLE 6

A graphite die similar to the design shown in FIG. 10 was fabricated. The die cavity was filled with a −100 mesh powder mixture of 93% (by weight) reduced iron, 7% copper, and stripes of −150 mesh 91% WC—9% Co powder. Cobalt was in the form of a thin coating on particles of tungsten carbide. During powder filling, the die was vibrated to allow proper filling of the cavity. Die cavity dimensions were 1.5 mm×15 mm×140 mm. WC—9% Co stripes had the dimensions of 0.5 mm×1.5 mm×15 mm, and were separated from each other by 3 mm. The powder mass was sintered for 30 minutes at 1100° C. in a vacuum furnace and cooled to room temperature. Sintered powdered skeleton was estimated to have 15% porosity by volume. A layer of copper powder infiltrant weighing 9 grams was applied over the sintered powder mass, and the assembly was heated in vacuum to 1100° C. for about 15 minutes for the infiltration process to take place. The infiltrated powder sheet was then longitudinally sectioned into three saw blanks as shown in FIG. 14, and used to cut ceramic investment casting shells without any further machining of teeth. After several minutes of cutting, teeth began to form due to the self-sharpening effect. Saw performance remained high and constant after the equilibrium (teeth) profile had developed.

In the light of the possibility for several modifications, the scope of the present invention should be interpreted solely from the following claims, as such claims are read in light of the disclosure.

I claim:

1. In the method of forming a self-sharpening blade having in combination a) a layered structure, b) said structure including a first layer extending to a blade cutting edge, c) said structure also including a second layer located at one side of said first layer, d) said first layer being exposed at said cutting edge, and substantially defining said cutting edge, e) said first layer having wear resistance superior to wear resistance of said second layer, f) said first layer thickness being less than about 1.5 mm and substantially equal to or less than an ultimate tip diameter defined as a blade cutting edge tip diameter providing a desirable cutting action in the intended service of said self-sharpening blade, the steps that include:

i) connecting said first and second layers, in side-by-side relation, and ii) exposing an edge of said first layer to define said cutting edge.

2. The method of claim 1 wherein said connecting includes directly adhering said layers.

3. The method of claim 1 wherein the materials of said first layer are selected from the group that includes plastics, metals, metal alloys, oxides of metals, silica, carbides of metals, silicon carbide, nitrides of metals, silicon nitride, boron nitride, borides of metals, diamond, diamond-like carbon, and their mixtures in any combination.

4. The method of claim 3 wherein the materials of said second layer are selected from the group that includes plastics, metals, metal alloys, oxides of metals, silica, carbides of metals, silicon carbide, nitrides of metals, silicon nitride, borides of metals, and their mixtures in any combination.

5. Method of claim 2 wherein said direct adhering includes one of the following processes:

| | |
|---|---|
| $x_1$ | vapor deposition |
| $x_2$ | ion plating |
| $x_3$ | coating |
| $x_4$ | adhesive bonding |
| $X_5$ | welding |
| $x_6$ | pressure bonding |
| $x_7$ | diffusion bonding |
| $x_8$ | brazing. |

6. Method of claim 1 wherein said connecting takes place simultaneously while said first and second layers are reduced in thickness under pressure.

7. The method of claim 2 wherein said direct adhering step is followed by a thickness reduction step, whereby blade thickness is reduced under pressure.

8. The method of claim 1 wherein said blade is subjected to heat-treatment prior to step ii).

9. The method of claim 8 wherein wear resistance of said first layer is increased by said heat-treatment.

10. The method of claim 9 wherein said increase in wear resistance of said first layer occurs as a result of a reaction between metallic elements contained within said first layer and one or more of elements carbon, oxygen, nitrogen, and boron.

11. The method of claim 10 wherein the source of said one or more elements carbon, oxygen, nitrogen, and boron prior to said reaction is located outside said blade.

12. The method of claim 10 wherein the source of said one or more elements carbon, oxygen, nitrogen, and boron prior to said reaction is located within said blade.

13. The method of claim 1 wherein the materials of said first and second layers prior to said connecting step ii) are provided in any of the following forms:

| | |
|---|---|
| $x_1$ | powder |
| $x_2$ | compressed powder |
| $x_3$ | compressed and partially sintered powder |
| $x_4$ | solid insert |
| $x_5$ | wrought sheet |
| $x_6$ | deposited layer |
| $x_7$ | liquid. |

14. The method of claim 1 including providing two or more additional layers located at one side of said first layer, and each layer characterized by wear resistance in accordance with the relation:

$$(Rw)\mathbf{1}>(Rw)\mathbf{2}>(Rw)\mathbf{3}>(Rw)\mathbf{4}\ .\ .\ .>(Rw)n$$

where (Rw)1 is the wear resistance of said first layer, (Rw)2 is the wear resistance of the second layer, (Rw)3 is the wear resistance of the third layer, if used (Rw)4 is the wear resistance of the fourth layer, if used and (Rw)n is the wear resistance of the "n" th layer, where n is a whole number between two and infinity, and represents the total number of material layers.

15. In the method of forming a self-sharpening blade having in combination a) a layered structure, b) said structure including a first layer extending to a blade cutting edge, c) said structure also including second and third layers located at opposite sides of said first layer, d) said first layer having wear resistance superior to wear resistance of said second and third layers, e) said first layer being exposed at said cutting edge, and substantially defining said cutting edge, f) said first layer thickness being less-than about 1.5 mm and substantially equal to or less than an ultimate tip diameter defined as a blade cutting edge tip diameter providing a desirable cutting action in the intended service of said self-sharpening blade, the steps that include:

i) connecting said first, second and third layers, in side-by-side relation, ii) exposing an edge of said first layer to define a cutting edge, and iii) providing chamfers toward both side regions of the-first layer proximate said cutting edge.

16. The method of claim 15 wherein said connecting includes directly adhering said layers.

17. The method of claim 15 wherein the materials of said first layer are selected from the group that includes plastics, metals, metal alloys, oxides of metals, silica, carbides of metals, silicon carbide, nitrides of metals, silicon nitride, boron nitride, borides of metals, diamond, diamond-like carbon, and their mixtures in any combination.

18. The method of claim 17 wherein the materials of said second and third layers, are selected from the group that includes plastics, metals, metal alloys, oxides of metals, silica, carbides of metals, silicon carbide, nitrides of metals, silicon nitride, borders of metals, and their mixtures in any combination.

19. Method of claim 16 wherein said direct adhering includes one of the following processes:

| | |
|---|---|
| $x_1$ | vapor deposition |
| $x_2$ | ion plating |
| $x_3$ | coating |
| $x_4$ | adhesive bonding |
| $x_5$ | welding |
| $x_6$ | pressure bonding |
| $x_7$ | diffusion bonding |
| $x_8$ | brazing. |

20. Method of claim 15 wherein said connecting takes place at the same time that said first, second, third, and other layers are reduced in thickness under pressure.

21. The method of claim 16 wherein said direct adhering step is followed by a thickness reduction step, whereby blade thickness is reduced under pressure.

22. The method of claim 15 wherein said blade is subjected to heat-treatment prior to step ii).

23. The method of claim 22 wherein wear resistance of said first layer is increased by said heat-treatment.

24. The method of claim 23 wherein said increase in wear resistance of said first layer occurs as a result of a reaction between metallic elements contained within said first layer and one or more of elements carbon, oxygen, nitrogen, and boron.

25. The method of claim 24 wherein the source of said one or more elements carbon, oxygen, nitrogen, and boron prior to said reaction is located outside said blade.

26. The method of claim 24 wherein the source of said elements carbon, oxygen, nitrogen, and boron prior to said reaction is located within said blade.

27. The method of claim 16 wherein the materials of said first, second and third layers prior to said connecting step ii) are provided in any of the following forms:

| | |
|---|---|
| $x_1$ | powder |
| $x_2$ | compressed powder |
| $x_3$ | compressed and partially sintered powder |
| $x_4$ | solid insert |
| $x_5$ | wrought sheet |
| $x_6$ | deposited layer |
| $x_7$ | liquid. |

28. The method of claim 15 including providing three or more additional layers located at opposite sides of said first layer, and each layer characterized by wear resistance in accordance with the relation:

(Rw)1>(Rw)23>(Rw)45>(Rw)67 . . .>(Rw)(n−1)n where (Rw)1 is the wear resistance of said first layer, (Rw)23 is the wear resistance of the material layers 2 and 3 located at both side regions of said first layer, (Rw)45 is the wear resistance of material layers 4 and 5 if used, and which are located next to said layers 2 and 3

(Rw)67 is the wear resistance of material layers 6 and 7 if used, and which are located next to said layers 4 and 5

(Rw)(n−1)n is the wear resistance of material layers (n−1) and n, next to layers (n−2) and (n−3), where n is a whole number equal or greater than 3, and represents the total number of material layers.

29. The method of claim 1 wherein a first self-sharpening blade is thereby formed, and including also forming a second self-sharpening blade having a) . . . f) components as defined in claim 1 and by steps that are the same as steps i) and ii) of claim 1, and including interconnecting said first and second blades in spaced relation for use in simultaneous cutting of work.

30. In the method of forming a self-sharpening blade having in combination a) a layered structure, b) said structure including a relatively harder first layer with relatively higher wear resistance extending to the blade cutting edge, c) said structure also including a second layer characterized by relatively lesser hardness and lesser wear resistance and located at one side of said first layer, the steps that include:

i) connecting said first and second layers, in side-by-side relation, and ii) exposing an edge of said first layer to define a cutting edge.

31. In the method of forming a self-sharpening blade having in combination a) a layered structure, b) said structure including a first layer with relatively higher wear resistance extending to the blade cutting edge, c) said structure also including two or more additional layers located at opposite sides of said first layer, and each characterized by wear resistance less than the wear resistance of said first layer, the steps that include:

i) connecting said layers in side-by-side relation, with said first layer sandwiched between two of said additional layers, and ii) exposing an edge of said first layer to define a cutting edge that protrudes relative to said two additional layers.

32. The method of claim 31 including exerting pressure on said layers to reduce the overall thickness of the blade.

33. The method of claim 10 wherein the materials of said first and second layers have substantially the same chemical composition prior to said reaction.

34. The method of claim 24 wherein the materials of said first, second, and third layers have substantially the same chemical composition prior to said reaction.

* * * * *